US005183425A

United States Patent [19]

Shiratori et al.

[11] Patent Number: 5,183,425

[45] Date of Patent: Feb. 2, 1993

[54] FLAT PICTURE DISPLAY DEVICE

[75] Inventors: Tetsuya Shiratori, Neyagawa; Fumio Yamazaki, Hirakata; Seiichi Taniguchi, Osaka, all of Japan

[73] Assignee: Matsushita Electric Industrial Co., Ltd., Osaka, Japan

[21] Appl. No.: 833,723

[22] Filed: Feb. 11, 1992

Related U.S. Application Data

[62] Division of Ser. No. 615,010, Nov. 19, 1990.

[30] Foreign Application Priority Data

Nov. 17, 1989 [JP] Japan ..... 1-3000512
May 31, 1990 [JP] Japan ..... 2-143119

[51] Int. Cl.[5] ..... H01J 9/18
[52] U.S. Cl. ..... 445/29; 228/182
[58] Field of Search ..... 228/178, 182, 212; 29/559; 445/29; 65/43

[56] References Cited

U.S. PATENT DOCUMENTS 3,759,207 9/1973 Terai ..... 228/212 X
4,690,319 9/1987 Smith et al. ..... 228/178 X
4,917,934 4/1990 Sempolinski ..... 65/43 X

*Primary Examiner*—Kenneth J. Ramsey
*Attorney, Agent, or Firm*—Wenderoth, Lind & Ponack

[57] ABSTRACT

A picture display device includes an envelope having a faceplate, having an inner surface formed with a phosphor screen, and a back covering coupled to the faceplate to define an evacuated chamber; filament-like cathode electrodes and electron beam control electrodes disposed within the evacuated chamber for emitting electron beams towards the phosphor screen; a cathode electrode support member for retaining the cathode electrodes and having one of opposite surfaces held in contact therewith; a shape retention plate for retaining at least the cathode electrodes and the support member in a predetermined curved shape; a plurality of support struts for fixing the shape retention plate in a face-to-face relationship with the phosphor screen; and a reinforcement grid structure disposed in contact with a surface of the shape retention plate opposite that facing the phosphor screen so as to follow the curvature of the shape retention plate.

1 Claim, 6 Drawing Sheets

FLAT PICTURE DISPLAY DEVICE

This is a divisional application of Ser. No. 07/615,010, filed Nov. 19, 1990.

BACKGROUND OF THE INVENTION

1. Field of the Invention

The present invention relates to a flat picture display device utilizing electron beams.

2. Description of the Prior Art

Examples of a flat picture display device utilizing electron beams well known in the art, are shown, respectively, in FIGS. 12 and 13 of the accompanying drawings.

In particular, the flat picture display device shown in FIG. 12 in a schematic side sectional representation is disclosed in Japanese Laid-open Patent Publication No. 63-187538, published in 1988. Referring to this figure, positioning members 116 are held in contact with parallel cathode electrode filaments 115 at respective regularly spaced locations so chosen that, in the event that some or all of the cathode electrode filaments 115 may undergo vibration which may constitute a cause for variation in brightness of an image being reproduced, nodes of vibration can lie at respective points of contact between the positioning members 116 and the cathode electrode filaments 115 thereby to minimize the influence which may be brought about by the vibration of the cathode electrode filaments 115 on the image being displayed.

According to the prior art system referred to above, however, in order for the positioning members 116 to be assuredly held in contact with the cathode electrode filaments 115, each of the positioning members 116 must have a precisely machined height, or otherwise an effective suppression of the vibration of the cathode electrode filaments 115 cannot be attained.

In view of this, an attempt has been made to use positioning members which each have an outwardly tapered end against which the cathode electrode filaments 115 are pressed, thereby to minimize the influence which may be brought about by the vibration of some or all of the cathode electrode filaments on the image being displayed. The prior art flat picture display device based on the above mentioned attempt is disclosed in, for example, Japanese Laid-open Patent Publication No. 1-33994, published in 1989, which is reproducted in FIG. 13 in a schematic sectional representation.

Referring now to FIG. 13, the prior art flat picture display device shown therein comprises a faceplate 21 having an inner surface deposited with phosphor material to provide a phosphor screen 22. The picture display device also comprises a back covering 23 which forms an evacuated envelope in cooperation with the faceplate 21. Cathode electrode filaments 24 extending parallel to each other and spaced a predetermined distance from each other are applied to a back electrode 20 in contact therewith, said back electrode 20 being so shaped as to protrude towards the phosphor screen 22. Positioned within the evacuated envelope and held between an electrode retainer 32 and the cathode electrode filaments 24 are electron beam control electrodes 25, 26 and 27 and electrically insulating spacers 28, 29, 30 and 31 which are so disposed as to alternate with the adjacent electron beam control electrodes 25 to 27. Reference numeral 34 designates an electrode support and reference numeral 35 designates an electrode back-up member. The illustrated flat picture display device is so designed and so structured that electron beams 36 emitted from the cathode electrode filaments 24 can travel through the assembly of control electrodes and then impinge upon the phosphor screen 22 to excite phosphor dots on the phosphor screen 22 thereby to emit light.

According to the second mentioned prior art publication, the assembly including the insulating spacers 29 to 31, the electron beam control electrodes 25 to 27 and the back electrode 20, to which a filament-like cathode support member **20*a* is disposed with the respective cathode filaments 24 interposed between the filament-like cathode support members 20*a* and the back electrode 20, is so shaped and so curved as to protrude towards the phosphor screen 22 by placing the assembly on a curved spacer 33 and then pressing the assembly against the curved spacer 33 by means of the back-up member 35. The curved spacer 33 provides a base for the shaping of the assembly and, hence, the back electrode 20 originally having a flat shape is curved at the final stage of the shaping process. Since a stack of the alternately disposed insulating spacers 28 to 31 and control electrodes 25 to 27 is interposed between the curved spacer 33 and the back electrode 20, the back electrode 20 will fail to have a smoothly curved shape and will undulate unless the stack of the insulating spacers and the control electrodes is assembled to have a uniform thickness over the entire surface thereof. If the back electrode 20 undulates, some or all of the cathode electrode filaments 24 would be unable to contact the respective filament-like cathode support members 20*a* uniformly over the entire length thereof and, as a result thereof, an effective elimination of any possible vibration of some or all of the cathode electrode filaments 24** cannot be accomplished.

In addition, in order to retain the curved shape of the assembly, an external force has to be applied uniformly over the entire surface of the curved spacer 33, thereby complicating the structure of the flat picture display device.

SUMMARY OF THE INVENTION

The present invention has been devised to substantially eliminate the above-discussed problems inherent in the prior art flat picture display device and provides an improved flat picture display device in which the assembly retains a uniformly curved shape substantially permanently with no need to apply an external force.

It is a related object of the present invention to provide a method of making a shape retention plate employed in the flat picture display device of the type referred to above.

In order to accomplish the above described objects of the present invention, there is provided a picture display device which comprises an envelope comprising a faceplate, having an inner surface forming a phosphor screen, and a back covering coupled to the faceplate to define an evacuated chamber; filament-like cathode electrodes and electron beam control electrodes disposed within said evacuated chamber for emitting electron beams towards the phosphor screen; a cathode electrode positioning means for retaining the cathode electrodes and having one of opposite surfaces held in contact therewith; a shape retention plate for retaining at least said cathode electrodes and said positioning means in a predetermined curved shape; a fixing means for fixing said shape retention plate in a face-to-face relationship with the phosphor screen; and a reinforcement grid structure disposed in contact with the surface of the shape retention plate opposite the phosphor screen so as to follow the curvature of the shape retention plate.

Preferably, the reinforcement grid structure comprises a plurality of reinforcement members disposed in a generally grid-like pattern with some of them extending in a first direction conforming to the curvature of the shape retention plate while the remaining reinforcement members extend in a second direction perpendicular to said first direction. The reinforcement members may be connected in a separable fashion with respect to each other.

According to the present invention, the provision of the reinforcement grid structure on the shape retention plate permits the shape retention plate to retain the curved feature without being adversely affected by any external force. Since a cathode electrode support member is placed on a convex surface of the shape retention plate so as to follow the curvature thereof, the precise formation of the curved feature of the cathode electrode support member can be realized easily. Consequently, as an electron beam generating device, a relatively simple structure can be employed for preventing the filament-like cathode electrodes from being vibrated.

Also, since the reinforcement members are connected in a separable fashion, not rigidly connected with respect to each other, while the reinforcement members are arranged in the grid-like pattern, the highly precisely curved feature of the shape retention plate can be retained without being adversely affected by a warp occurring in the reinforcement members and a thermal transmission among the reinforcement members and, also, without increasing the number of manufacturing steps.

Furthermore, the reinforcement members are preferably connected with the shape retention plate by means of a plurality of connecting members disposed to one side of each of said reinforcement members, each having at least two contact faces which are angled relative to each other and are held in contact with each reinforcement member and the shape retention plate, respectively. In this case, the angle between said two contact faces is somewhat elastically variable.

Each of said reinforcement members extending in said second direction may preferably comprise discrete components each being disposed between each neighboring pair of reinforcement members extending in the first direction so as to extend perpendicular thereto.

The present invention also provides a method of making the shape retention plate used in the picture display device referred to above. This method comprises the steps of placing a flat plate on a reference plane of a predetermined curvature, and placing on the flat plate on the reference plane a reinforcement grid structure which comprises a plurality of reinforcement members, some of which extend in a first direction conforming to a curvature of the flat plate, the remaining reinforcement members extending in a second direction perpendicular to the first direction. In the practice of this method, the reinforcements extending in the first and second directions are connected in a separable fashion with respect to each other during the placing of the reinforcement grid structure on the flat plate.

According to the method herein provided, the flat plate can be advantageously caused to follow a curvature of the reference plane so that the flat plate can have a curved surface which is subsequently reinforced by the reinforcement grid structure, thereby to complete the curved shape retention plate. The formation of the curved shape retention plate with the reinforcement grid structure can readily and easily be accomplished.

BRIEF DESCRIPTION OF THE DRAWINGS

These and other objects and features of the present invention will become clear from the following description taken in conjunction with a preferred embodiment thereof with reference to the accompanying drawings, in which.

DETAILED DESCRIPTION OF THE PREFERRED EMBODIMENT

Figure 1:
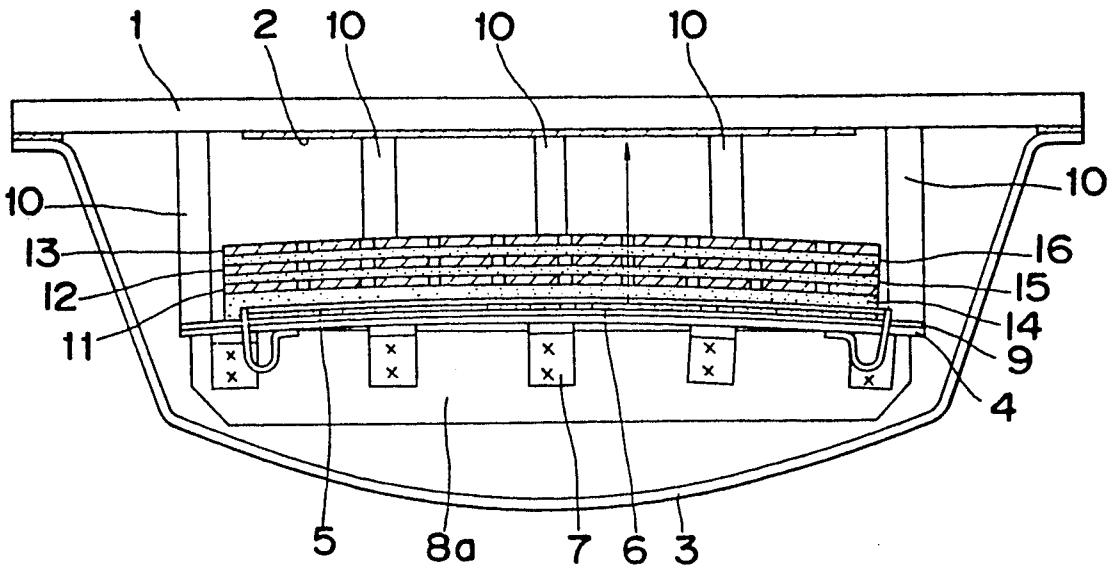
FIG. 1 is a sectional view of an essential portion of a flat picture display device embodying the present invention.
Figure 13:
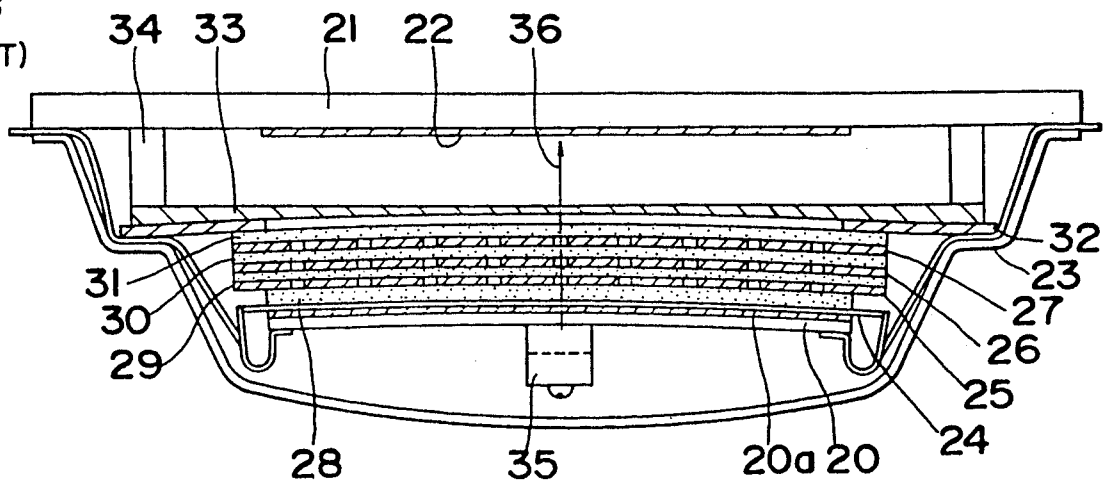
Fig. 13 (PRIOR ART)
FIG. 13 is a sectional view, similar to FIG. 1, showing another type of prior art flat picture display device.
Figure 2:
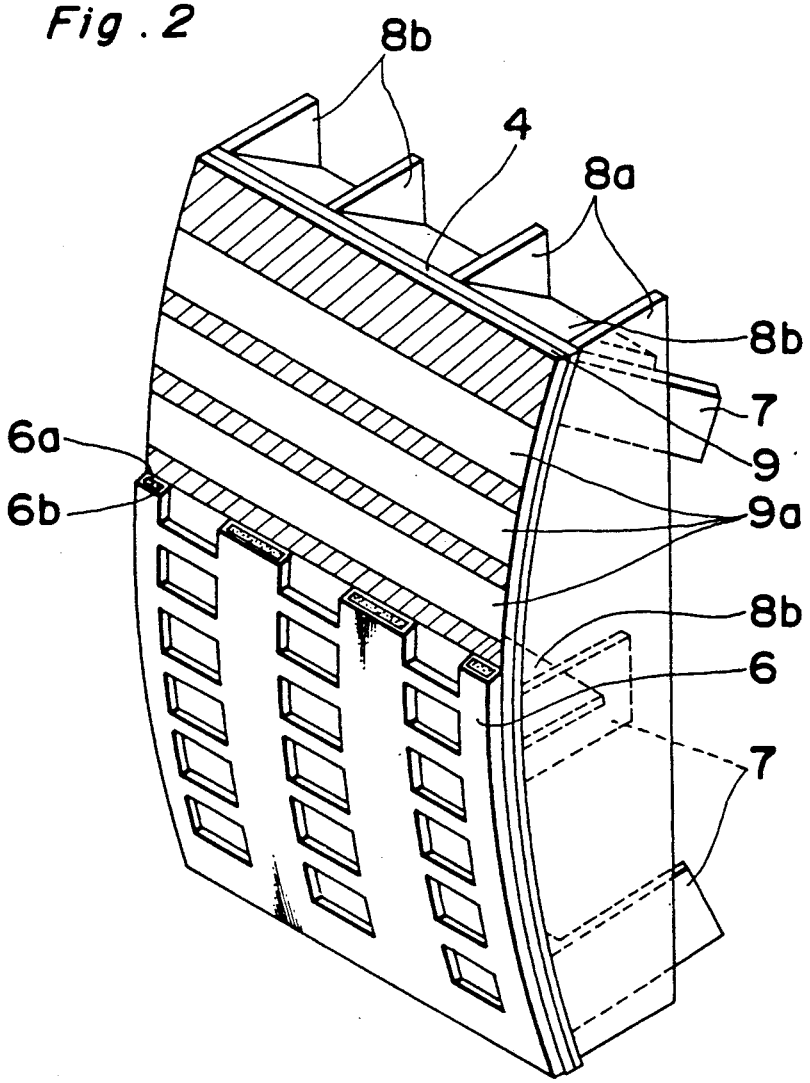
FIG. 2 is a perspective view of a shape retention plate used in the flat picture display device according to the present invention.
Figure 3:
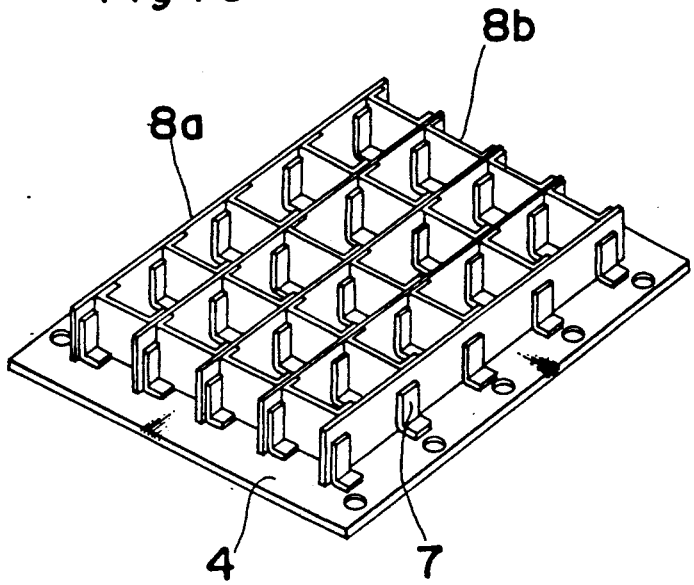
FIG. 3 is a perspective view of a portion of the shape retention plate of FIG. 2 as viewed from a different direction, i.e., from the rear.

Referring first to FIGS. 1 to 3, a flat picture display device embodying the present invention comprises an evacuated envelope comprised of a faceplate 1 and a back covering 3, said faceplate 1 having an inner surface deposited with phosphor material to provide a phosphor screen 2. A shape retention plate 4 best shown in FIG. 2 provides a base for retaining a cathode support member 6, used for the prevention of any possible vibration of some or all of cathode filaments 5 which would adversely affect the quality of an image being reproduced, in a generally curved shape protruding towards the phosphor screen 2. The shape retention plate 4 comprises a curved plate member having a shape of a portion of of a cylinder and having concave and convex surfaces opposite to each other, a plurality of generally L-shaped fixtures 7 rigidly secured to the concave surface of the curved plate member a generally equally spaced relationship in two directions perpendicular to each other, and a reinforcement grid structure secured to the concave surface of the curved shape retention plate 4. The reinforcement grid structure referred to above includes a plurality of reinforcement plates 8*a* in a plane perpendicular to the curved shape retention plate 4 and extending parallel to each other in a widthwise direction as viewed in FIG. 1, and a plurality of cross plates 8*b* lying in a plane perpendicular to the curved shape retention plate 4 and extending in a direction perpendicular to the reinforcement plates 8*a* and substantially parallel to each other, said plates 8*a* and 8*b* being welded to the L-shaped fixtures 7.

A back electrode 9 and the cathode support member 6 are laminated and fixed in position on the convex surface of the curved shape retention plate 4. It is to be noted that the back electrode substrate 9 has an outer surface opposite to the curved shape retention plate 4, which has an electrically insulating property. On this outer surface of the curved shape retention plate 4 is formed parallel stripe-shaped, thin-film switching electrodes 9*a* for the extraction of electron beams. As best shown in FIG. 2, the cathode support member 6 is in the form of a grid having a plurality of straight bars, held in contact with the cathode filaments 5 and extending in a direction conforming to the curvature of the shape retention plate 4 and a plurality of cross bars extending perpendicular to the straight bars and aligned with and parallel to the electrically insulating outer surface portions of the curved shape retention plate 4 between the neighboring switching electrodes 9*a*.

The cathode support member 6 must have a required dimensional preciseness, a heat resistance, an insulating property and other properties and, therefore, this cathode support member 6 is prepared by perforating a metal plate 6*a* by the use of any known etching technique and then coating such a plate 6*a* with a heat-resistant, electrically insulating material such as, for example, alumina, to form a heat-resistant insulating layer 6*b*. The back electrode 9 and the cathode support member 6 are fixedly held together in an electrically insulating relationship. The rigid contact between the back electrode 9 and the cathode support member 6 can be achieved by the use of, for example, a fusion bonding method using an insulating frit.

With the cathode support member 6 so structured and so shaped as to exhibit a generally curved configuration, the cathode filaments 5 forming cathode electrodes are stretched thereover so as to follow the curvature of the cathode support member 6. In order to assuredly prevent some or all of the cathode filaments 5 from vibrating, the cathode filaments 5 have to be held in tight abutment with the cathode support member 6 and, for this purpose, the cathode support member 6 must have a precisely designed curvature. It has been found that the prevention of the cathode filaments 5 from undergoing vibration requires the cathode support member 6 to have a radius of curvature of about 75,000 mm and to have a surface undulation within a tolerance of about 0.02 mm. In order for the cathode support member 6 to satisfy those strict requirements, not only should the curved feature of the shape retention plate 4 be carefully designed, but also the shape retention plate 4 should retain the carefully designed curved feature substantially permanently and, at the same time, the cathode support member 6 can be readily installed in the display device.

In order for the shape retention plate 4 to be lightweight while allowing the cathode support member 6 to satisfy the foregoing requirements, the present invention makes use of the reinforcement grid structure including the reinforcement plates 8*a* and the cross plates 8*b* in combination with the L-shaped fixtures 7 as hereinbefore discussed. In order to allow the shape retention plate 4 to retain its curved feature substantially permanently, as hereinbefore described, the shape retention plate 4 is so configured as to have a shape generally occupying a portion of a cylinder thereby to have the concave and convex surfaces opposite to each other. The generally L-shaped fixtures 7 are rigidly secured to the concave surface of the shape retention plate 4 in a generally equally spaced relationship in two directions perpendicular to each other, and the reinforcement plates 8*a* and the cross plates 8*b* are subsequently anchored to the L-shaped fixtures 7 in a fashion allowing the plates 8*a* and 8*b* to form the grid structure.

Figure 4:
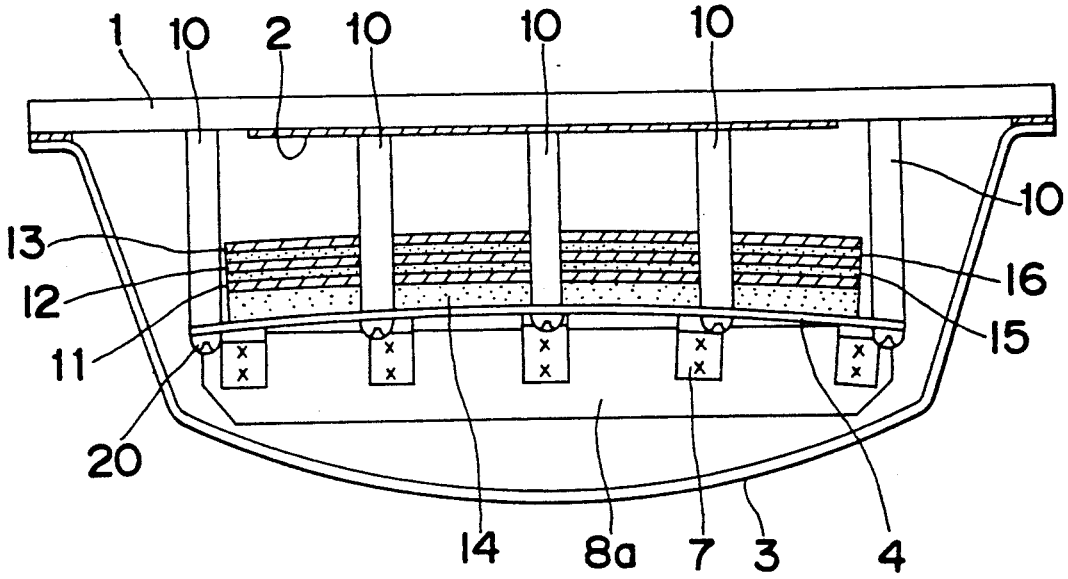
FIG. 4 is a view similar to FIG. 1, showing an example in which the shape retention plate is fixed in position inside the flat picture display device.
Figure 5:
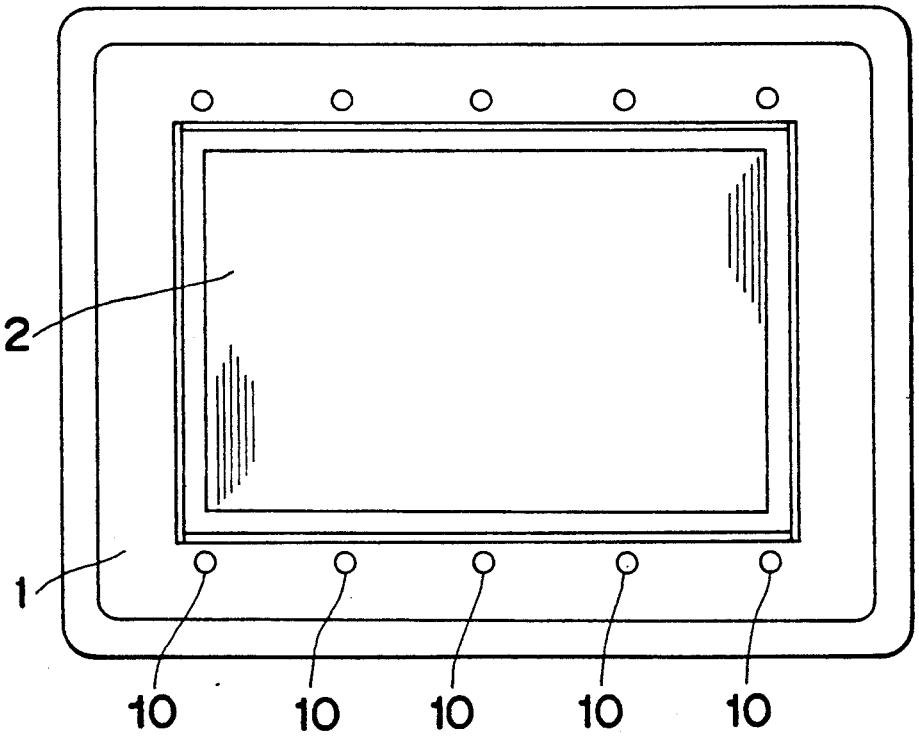
FIG. 5 is a plan view showing fixing points in the flat picture display device shown in FIG. 4.

The installation of the curved shape retention plate 4, within the evacuated envelope defined by the faceplate 1 and the back covering 3, can be accomplished by securing a peripheral region of the curved shape retention plate 4 in place with a plurality of set screws 20 threaded to fixing means 10 as shown in FIGS. 4 and 5. The fixing means 10 may be in the form of a corresponding number of support struts bonded at one end to an inner surface of the faceplate 1, said support struts 10 having progressively varying lengths so chosen as to conform to the curvature of the shape retention plate 4.

Figure 6A:
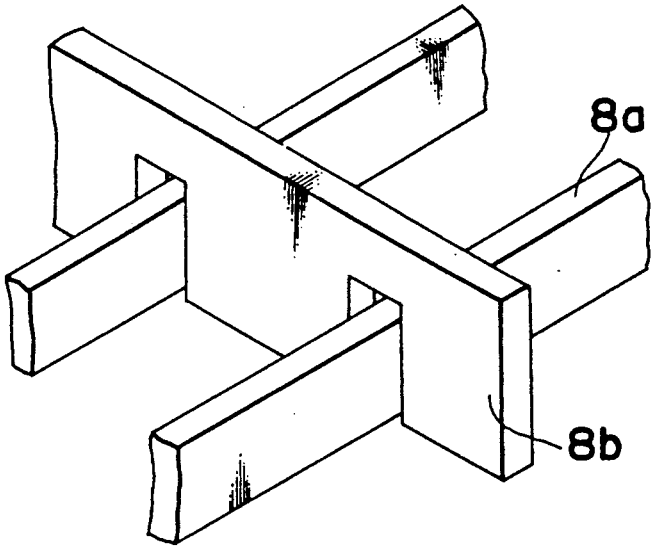
FIGS. 6(*a*), 6(*b*) and 7 to 10 are perspective views showing different methods of connecting reinforcement plates with L-shaped fixtures.
Figure 6B:
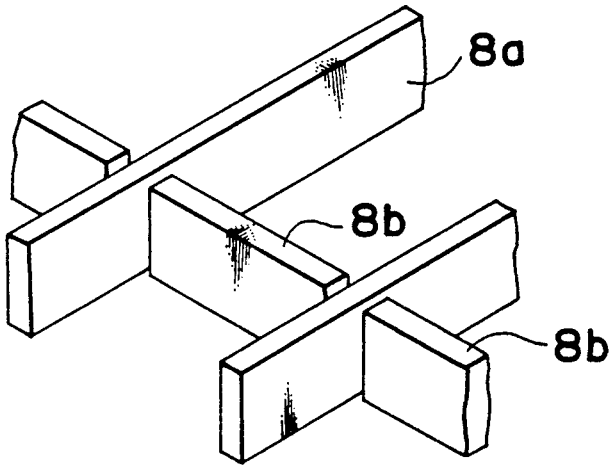
Figure 8:
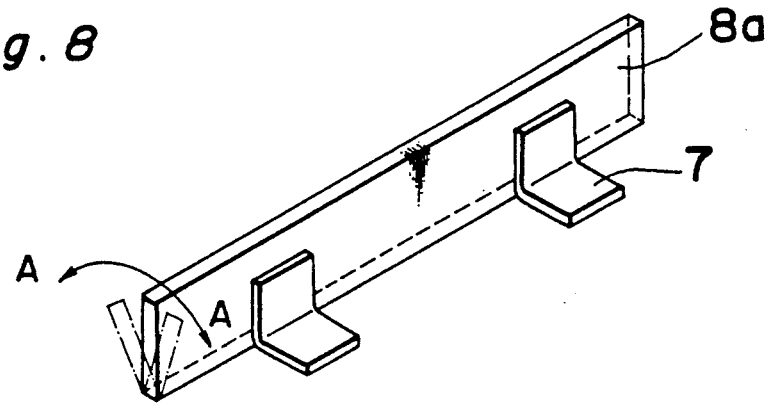
Figure 9:
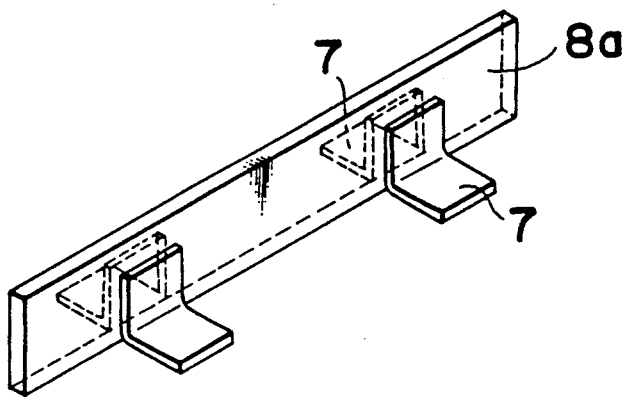

While the reinforcement grid structure of a construction shown in and described with particular reference to FIGS. 2 and 3 is effective to allow the curved shape retention plate 4 to exhibit a desired performance, the reinforcement grid structure may be of a construction shown in any one of FIGS. 6, 8 and 9 when it is desired to impart a more precisely curved feature to the shape retention plate 4.

Figure 7:
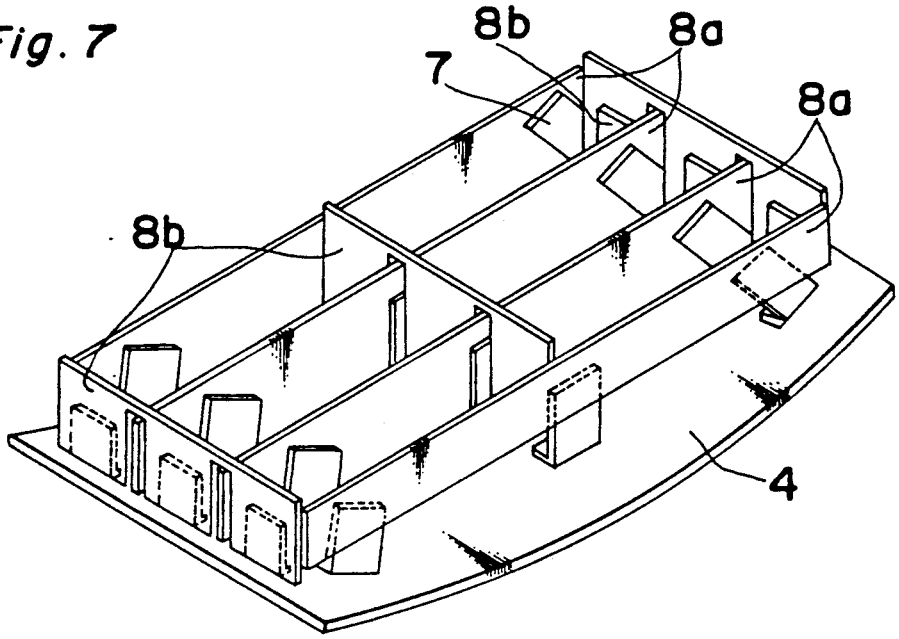

According to a modification shown in any one of FIGS. 6(*a*) and 6(*b*), while the reinforcement and cross plates 8*a* and 8*b* are arranged in a substantially grid-like pattern and are secured to the shape retention plate 4 in the manner as hereinbefore described, they are not rigidly connected together and are separable from each other. FIG. 7 illustrates the modified reinforcement grid structure as viewed from rear and as rigidly secured to the curved shape retention plate 4.

When the reinforcement and cross plates 8*a* and 8*b* forming the reinforcement grid structure are rigidly connected or otherwise bonded or welded together, there may be a possibility that they are rigidly connected together with some of them tilted relative to the remaining plates and/or with internal stresses and internal strains built up in some or all of the plates 8*a* and 8*b*. Once this occurs, the shape retention plate 4 to which the reinforcement grid structure is secured will fail to exhibit a smoothly curved feature, accompanied by a surface undulation. Therefore, the separable connection of the reinforcement and cross plates 8*a* and 8*b* such as shown in any one of FIGS. 6(*a*) and 6(*b*) is effective and advantageous in that the reinforcement and cross plates 8*a* and 8*b* can exhibit a straightness in respective directions perpendicular to each other while allowing the shape retention plate 4 to exhibit the smoothly curved feature. According to the result of a series of experiments conducted by the inventors of the present invention, it has been found that, when the reinforcement and cross plates are rigidly connected together in the grid-like pattern, a surface undulation of about 30 μm was found on the convex surface of the shape retention plate 4, but the surface undulation could be suppressed to a value smaller than 1 to 2 μm when the reinforcement and cross plates 8*a* and 8*b* are separably connected in the grid-like pattern.

Also, the reinforcement grid structure has been found effective in rendering the curved shape retention plate 4 to exhibit a rigidity required for the curved shape retention plate 4 to retain the radius of curvature of 75,000 mm at all times.

In particular, according to the modification shown in FIG. 6(*b*), each of the cross plates 8*b* may not be in the form of a single strip, but may be in the form of discrete strips each being of a length equal to the span between each pair of neighboring reinforcement plates 8*a* which extend in a direction conforming to the curvature of the shape retention plate 4. The inventors of the present invention have confirmed that even a series of aligned discrete strips can provide a sufficient straightness. Accordingly, where the presence of a dead space is critical during assembly, the use of the modified reinforcement grid structure wherein the reinforcement and cross plates 8*a* and 8*b* are separably connected together is recommended.

Also, the result of a series of experiments conducted by the inventors of the present invention has shown that when the L-shaped fixtures 3 are arranged to one side of the respective reinforcement plates 8*a*, the curved feature of the shape retention plate 4 can be substantially improved.

Figure 10:
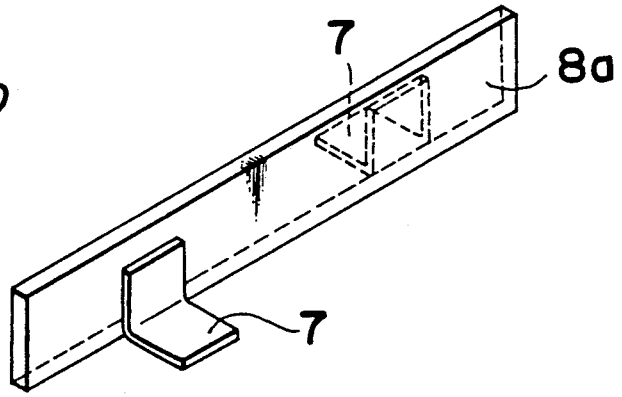
Figure 12:
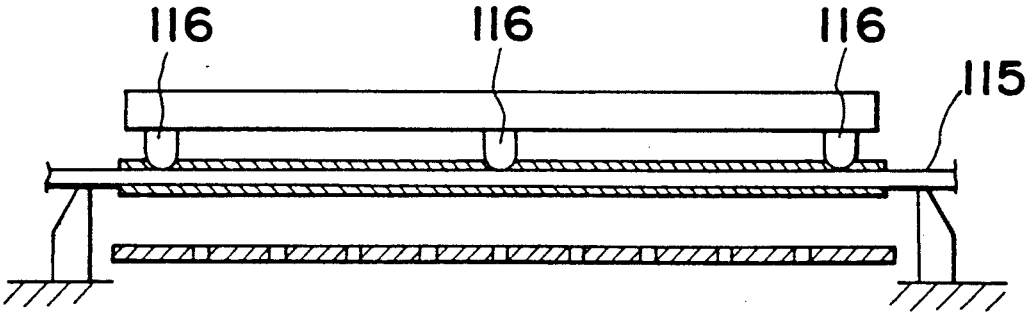
Fig. 12 Prior Art
FIG. 12 is a schematic sectional view of one type of prior art flat picture display device.
Figure 11A:
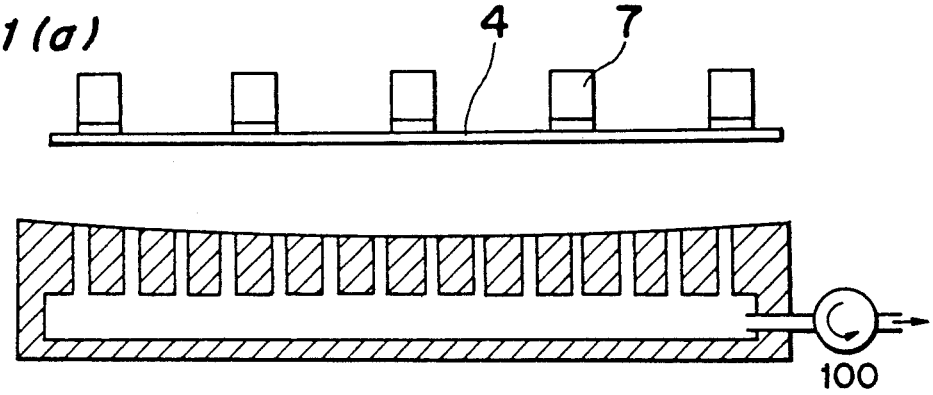
FIGS. 11 (*a*) to 11 (*d*) are diagrams showing the sequence of manufacture of the shape retention plate used in the practice of the present invention.
Figure 11B:
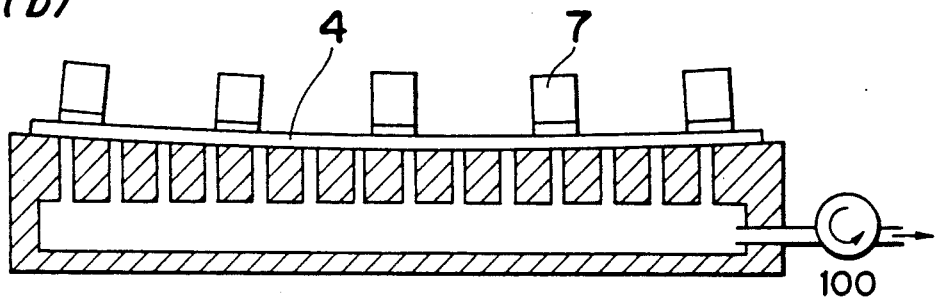
Figure 11C:
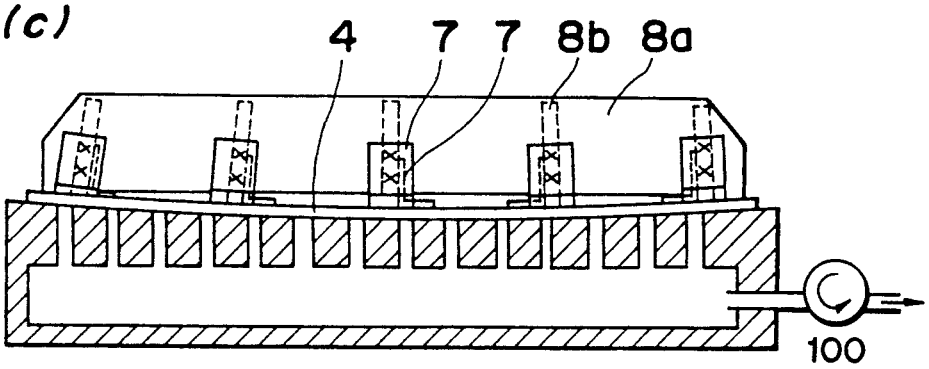
Figure 11D:
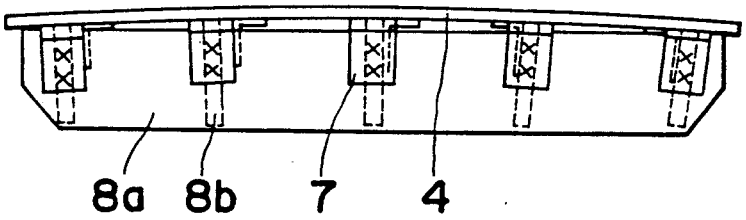

By way of example, when the L-shaped fixtures 7 are disposed on respective sides of each of the reinforcement plates 8*a* as shown in any one of FIGS. 9 and 10, a surface undulation of about 20 to 30 μm has been found on the curved surface of the shape retention plate 4 with the vibration preventive effect being adversely affected. However, according to the arrangement shown in FIG. 8, the surface undulation could be suppressed to a value smaller than 1 to 2 μm. It has also been found that the reinforcement grid structure could render the curved shape retention plate 4 to exhibit both a curved rigidity and a curved strength required for the curved shape retention plate 4 to retain the radius of curvature of 75,000 mm at all times.

The reason therefor can be posited as follows. In general, when each reinforcement plate 8*a* is mounted while sandwiched between the L-shaped fixtures 7 such as shown in any one of FIGS. 9 and 10, the bonding strength of each reinforcement plate 8*a* will be considerably increased. However, it may occur that the following adverse effects will be brought about upon the curved feature.

One is that, if a variation in shape is found among the L-shaped fixtures 7, an undulation and/or a force will be induced in the reinforcement plates 8*a*, which would eventually be transmitted undesirably to the shape retention plate 4 through the L-shaped fixtures 7 firmly secured thereto.

Another is that the shape retention plate 4 tends to regain, to a certain extent, its initial curved shape (the shape conforming to a reference plane) thereby assuming a deformed shape (the shape resulting from a change in curvature of the curved shape) and then to stabilize in the deformed shape. On the other hand, since the reinforcement plates 8*a* are secured to the shape retention plate 4 in its initial curved shape (the shape conforming to the reference plane) and, moreover, each reinforcement plate 8*a* is connected with the shape retention plate 4 at several locations over the entire length of the respective reinforcement plate 8*a*, the tendency of the shape retention plate 4 to deform causes each reinforcement plate 8*a* to deform (tilt and/or bend) at the joints where the respective reinforcement plate 8*a* is connected to the shape retention plate 4 through the corresponding L-shaped fixtures 7. Once this occurs, the deformation (tilt and/or bending) of the respective reinforcement plates 8*a* will bring about an adverse influence on the shape retention plate 4 while the joints through which the respective reinforcement plates 8*a* are firmly secured to the shape retention plate 4 resist the possible deformation of the respective reinforcement plates 8*a*.

However, when the L-shaped fixtures 7 are rigidly connected to each reinforcement plate 8*a* while disposed only to one side of the respective reinforcement plates 8*a* such as shown in FIG. 8, each respective reinforcement plate 8*a* can deform or flex in any one of the opposite directions, shown by the arrow A in FIG. 8, generally about an axis parallel to the longitudinal axis of the reinforcement plate 8*a* and, accordingly, the above described adverse influences will not be brought on the shape retention plate 4, thereby permitting the latter to favorably retain the precisely designed curved feature.

In view of the foregoing structural system according to the present invention, the cathode support member 6 disposed on the curved shape retention plate 4 so as to follow the curvature of the shape retention plate 4 can have the cathode filaments 5 held in tight contact therewith to accomplish a firm and reliable contact between the cathode filaments 5 and the cathode support member 6. The electron beam control electrodes 11, 12 and 13, each in the form of a finely perforated flat plate, are positioned in front of the cathode filaments 5 with respect to the direction towards the phosphor screen 2 so that the heating of the cathode filaments 5 to a high temperature can result in an emission of heat electrons and so that, when predetermined potentials are applied across the electron beam control electrodes 11, 12 and 13 and the switching electrodes 9*a* on the back electrode 9, electron beams can be produced so as to travel frontwardly towards the phosphor screen 2.

As hereinbefore described, the control electrodes 11, 12 and 13 are stacked one on top of the other while alternating with the insulating spacers 14, 15 and 16 each positioned between a pair of neighboring control electrodes.

The use of the reinforcement grid structure to support the shape retention plate 4 and, hence, the cathode support member 6 in the precisely designed curvature advantageously permits the cathode support member 6 to retain a curved shape regardless of any external force and also to permit the flat picture display device to be light-weight. Consequently, the magnitude of vibration which the cathode filaments 5 may undergo can be regulated to a value which would not adversely affect the quality of the image being displayed or reproduced.

Hereinafter, the method of assembling the shape retention plate 4 will be described with reference to FIGS. 11(*a*) to 11(*d*). As shown in FIG. 11(*a*), the shape retention plate 4 having the L-shaped fixtures 7 welded thereto at predetermined locations on one surface thereof is placed on a suction mold assembly having a perforated molding wall and also having an interior communicating with a vacuum pump 100. An outer surface of the perforated molding wall is so shaped and so curved as to provide the reference plane which would eventually define the convex surface of the shape retention plate 4. After the shape retention plate 4 has been placed on the concave outer surface of the perforated molding wall of the suction mold assembly, the vacuum pump 100 is activated to evacuate the interior of the suction mold assembly to allow the shape retention plate 4 to be drawn close towards and held in tight contact with the concave outer surface of the perforated molding wall as shown in FIG. 11(*b*), while an atmospheric pressure acts as an external force on the surface of the plate 4 to which the L-shaped fixtures 7 are welded.

While the condition of FIG. 11(*b*) is maintained, the reinforcement plates 8*a* and the cross plates 8*b* are mounted exteriorly on the shape retention plate 4 in the grid-like pattern as hereinbefore described while the atmospheric pressure is applied thereto, followed by an introduction of the atmospheric pressure into the interior of the mold assembly to facilitate the separation of the assembly of the reinforcement grid structure and retention plate 4 from the suction mold assembly. After the assembly has been removed from the mold assembly, the shape retention plate 4 backed up by the reinforcement grid structure retains the curved shape.

In the foregoing embodiment, each of the L-shaped fixtures 7 is a thin metal plate. To rigidly connect each L-shaped fixture 7 with the shape retention plate 4 at one leg and with the reinforcement plate 8*a* at the opposite leg, a welding technique may be employed. When the welding technique is employed, care should be taken to avoid any possible transmission of thermal energy to the shape retention plate 4. Therefore, the welding should be carried out using a minimal quantity of energy and, accordingly, in the practice of the present invention, 4 mW·sec of welding energy was employed for each L-shaped fixture having a wall thickness of 0.15 mm. As a result thereof, the reinforcement grid structure could be fitted to the shape retention plate 4 without adversely affecting the curved feature of the shape retention plate 4.

From the foregoing description, it has now become clear that, since according to the present invention a cathode support means is disposed directly on a prefabricated curved electrode support means for the prevention of vibration of the cathode filaments, any possible vibration of some or all of the cathode filaments can be reliably and assuredly accomplished, that the highly precisely curved feature of the shape retention plate can be obtained by a simple method, and that an inexpensive and light-weight curved electrode support means can be obtained.

Although the present invention has been described in connection with the preferred embodiment thereof with reference to the accompanying drawings, it is to be noted that various changes and modifications are apparent to those skilled in the art. Such changes and modifications are to be understood as included within the scope of the present invention as defined in the appended claims, unless they depart therefrom.

What is claimed is:

1. A method of manufacturing shape retention structure for retaining filament electrodes of a flat picture display device in a predetermined curved shape, said method comprising the steps of:

placing a shape retention plate on a concave outer surface of a mold, the concave surface having a predetermined curvature;

forcing said shape retention plate under pressure into contact with the concave outer surface of the mold so as to conform to the predetermined curvature thereof;

securing a plurality of rows of equal numbers of fixtures to a surface of the shape retention plate, opposite the surface thereof which contacts the concave outer surface of the mold in said step of forcing, in such a manner that the fixtures of each said row are spaced from one another in a first direction corresponding to the direction in which the outer concave surface of the mold is curved and in such a manner that the rows of fixtures are spaced from another in a second direction perpendicular to said first direction;

while the shape retention plate is conformed to the predetermined curvature of the outer surface of the mold, connecting first elongate reinforcement plates, equal in number to the number of said rows of fixtures, to the shape retention plate via said fixtures in such a manner that said first elongate reinforcement plates extend in said first direction;

while the shape retention plate is conformed to the predetermined curvature of the outer surface of the mold, connecting second elongate reinforcement plates, equal in number to said number of fixtures in each row thereof, to said shape retention plate in such a manner that said second elongate reinforcement plates extend across said first elongate reinforcing plates in said second direction without being rigidly connected to said first elongate reinforcement plates at those locations where the reinforcing plates cross, whereby the reinforcing plates constitute a grid-like structure secured to the shape retention plate; and subsequently removing the shape retention plate and the grid-like structure secured thereto from the mold.

* * * * *